US005620099A

United States Patent [19]

Bickett et al.

[11] Patent Number: 5,620,099

[45] Date of Patent: Apr. 15, 1997

[54] COMBINED PORTABLE SCORING SYSTEM AND STORAGE/CARRIER UNIT

[76] Inventors: Earl H. Bickett, 2113 E. Michigan Blvd., Michigan City; Kevin Coleman, 2626 Belle Plaine Trail, Long Beach, both of Ind. 46360; Michael Yurkovic, 5234 N. Leamington, Chicago, Ill. 60630

[21] Appl. No.: 348,113

[22] Filed: Nov. 28, 1994

[51] Int. Cl.[6] ..... B65D 1/34

[52] U.S. Cl. ..... 206/579; 116/222; 116/321

[58] Field of Search ..... 206/579; 116/222, 116/225, 321, 323; 373/DIG. 26

[56] References Cited

U.S. PATENT DOCUMENTS

| | | | |
|---|---|---|---|
| 710,993 | 10/1902 | Norrington . | |
| 2,477,825 | 8/1949 | Richardson . | |
| 3,246,411 | 4/1966 | Aafedt | 116/222 |
| 3,889,805 | 6/1975 | Korten | 206/579 |
| 4,036,416 | 7/1977 | Lowe . | |
| 4,105,119 | 8/1978 | Cowan . | |
| 4,840,376 | 6/1989 | Garret | 273/DIG. 26 |
| 4,900,027 | 2/1990 | Sheridan | 273/DIG. 26 |
| 5,054,792 | 10/1991 | Danielson . | |
| 5,100,324 | 3/1992 | Slayton | 206/579 |

*Primary Examiner*—David T. Fidei
*Attorney, Agent, or Firm*—C. J. Husar

[57] ABSTRACT

The invention relates to a combined portable scoring system and storage/carrier unit. There is disclosed a portable storage/carrier unit which is intended to be used for storing and carrying sporting equipment of any type when used or not used for scoring a game. Upon arrival at a game site, the equipment and first-aid supplies are removed as needed from the storage/carrier unit, closed and placed in an upright position. The storage/carrier unit includes a plurality of pockets formed in the outer planar surface of at least one side of the unit by a plurality of continuous tracks and accommodates scoring number packets, home team and guest team names as well as a sponsor's name. A centrally located rotary pointer dial is provided to indicate the inning or quarter of play. An out indicator is provided as well. Upon completion of the game or games, the scoring numbers, inning/out indicator, team names and sponsor names are removed from their respective positions and along with sporting equipment and first-aid supplies are stowed within the storage/carrier unit. The scoring system can be used for a variety of different games.

17 Claims, 4 Drawing Sheets

COMBINED PORTABLE SCORING SYSTEM AND STORAGE/CARRIER UNIT

BACKGROUND OF THE INVENTION

The present invention relates to a portable combined scoring system and storage/carrier unit. More specifically, it relates to a combined portable multi-game scoring system and storage/carrier unit for game equipment, first aid and other supplies whether in use or not.

There are currently a variety of game scoring devices in the prior art. For example, U.S. Pat. No. 710,993, issued to Norrington, relates to a score indicator including a box cardcase for stowing playing cards when not in use. U.S. Pat. No. 2,477,825, issued to Richardson, discloses a peg scoreboard including a container having a reversible cover with score receiving peg pockets in one face and space in the container for several decks of cards. U.S. Pat. No. 4,036,416, issued to Lower, discloses a foldable A-frame golf club carrier and a score rule handle for fast and single score keeping. U.S. Pat. No. 4,105,119, issued to Cowan, discloses a dart game which includes a crossbar for storing the darts when not in use and a pair of rotary scoring wheels. U.S. Pat. No. 5,054,792, issued to Danielson, discloses another dart game scoring system which includes a central target wall and a pair of oppositely disposed scoring panels.

As can readily be seen from the above discussed prior art patents, they are all basically directed to a single game activity and provide a very limited amount of storage space for game equipment of the type embodied by the instant invention. Additionally, there is no provision for convenient shoulder carrying as herein provided.

Today, with an ever increasing emphasis on the healthful development of our children, there has developed a national surge in the number of Little Leagues for every conceivable sport activity including, but not limited to, T-ball, softball, baseball, soccer, tennis, volley ball, basketball, football, wrestling, swimming and many other sports. The field of activities has expanded to include female teams, mixed teams and the traditional all male teams at all age levels from pre-kindergarten on up. Thus there has developed a tremendous need for a multi-game scoring system and equipment storage/carrier unit for the equipment and supplies whether it is in use or not.

In view of the above known deficiencies of the prior art and the enormous need for a combined scoring system and equipment storage/carrier unit, applicants have endeavored to satisfy this need with the subject invention.

SUMMARY OF THE INVENTION

The subject invention provides a portable lightweight storage/carrier unit for sporting equipment and first-aid supplies when the equipment is in use or not in use and upon arrival at the playing site, the equipment and first-aid supplies are stored and removed as needed, the unit is closed and is now used as a scoring system for the game about to be played. The scoreboard is formed on the front outer surface of one side of the storage/carrier unit. The front outer surface includes pockets for receiving scoring number packets which indicate the score as the game progresses. Additionally, it includes a centrally located inning/out insert which includes a rotatable pointer which designates the period, inning, or quarter of the game presently being played, or whatever other unit of game time is utilized in that particular game. The removable inning/out insert is imprinted with different numerical indicia notations on each side. Thus a single insert can be used for two different types of games. A plurality of such inserts are provided to cover the most popular sporting activities played. As the game progresses, the scoring numbers, which are provided on a spiral bound packet and includes a series of numbers 0–9 for each scoring pocket with the changes being made by sliding the number packet out of the pocket, changing to the appropriate number and re-inserting the packet into the pocket. As the innings progress, (assuming baseball, softball or T-ball is the game in progress), the pointer is manually rotated to indicate the appropriate inning. Of course, if the scoring system were to be used for a football game, the inning/out insert would be reversed to show the four quarters of the game and the pointer dialed to show the current quarter of play. As indicated above, other sporting activities are accommodated by additional inserts as required for that particular game. An out indicator is also provided to indicate the number of outs in the inning of play. Merely flipping the out number panel changes to the appropriate out, three such panels are provided.

After completion of the game or games, the score indicating packets are removed from their respective pockets and upon opening of the storage/carrier unit, the scoring material, game equipment, caps, shirts and first-aid supplies are stowed within the carrier prior to closing. A convenient shoulder carrying strap is provided to free the user's hands for high-fiving.

OBJECTS OF THE INVENTION

An object of the invention is to provide a portable combined scoring system and equipment storage/carrier unit.

Another object of the invention is to provide a portable combined scoring system and equipment storage/carrier unit made of lightweight, highly durable, impact and weather resistant plastic material.

A further object of the invention is to provide a portable combined scoring system which includes indicator means for a plurality of different games.

A still further object of the invention is to provide a scoring system which includes highly visible, weather resistant numbers.

Yet another object of the invention is to provide an equipment storage/carrier unit when used for scoring a game or when not used for scoring a game.

A further object of the invention is to provide an equipment storage/carrier unit which includes advertising and sponsorship features on the outer surfaces thereof.

Another object of the invention is to provide the combined scoring system and storage/carrier unit with a convenient shoulder strap to free the user's hands.

These and other objects of the invention will become more apparent hereinafter. The instant invention will now be described with particular reference to the accompanying drawings which form a part of the specification wherein like reference characters designate the corresponding parts in the several views.

DETAILED DESCRIPTION OF THE DRAWINGS

Figure 1:
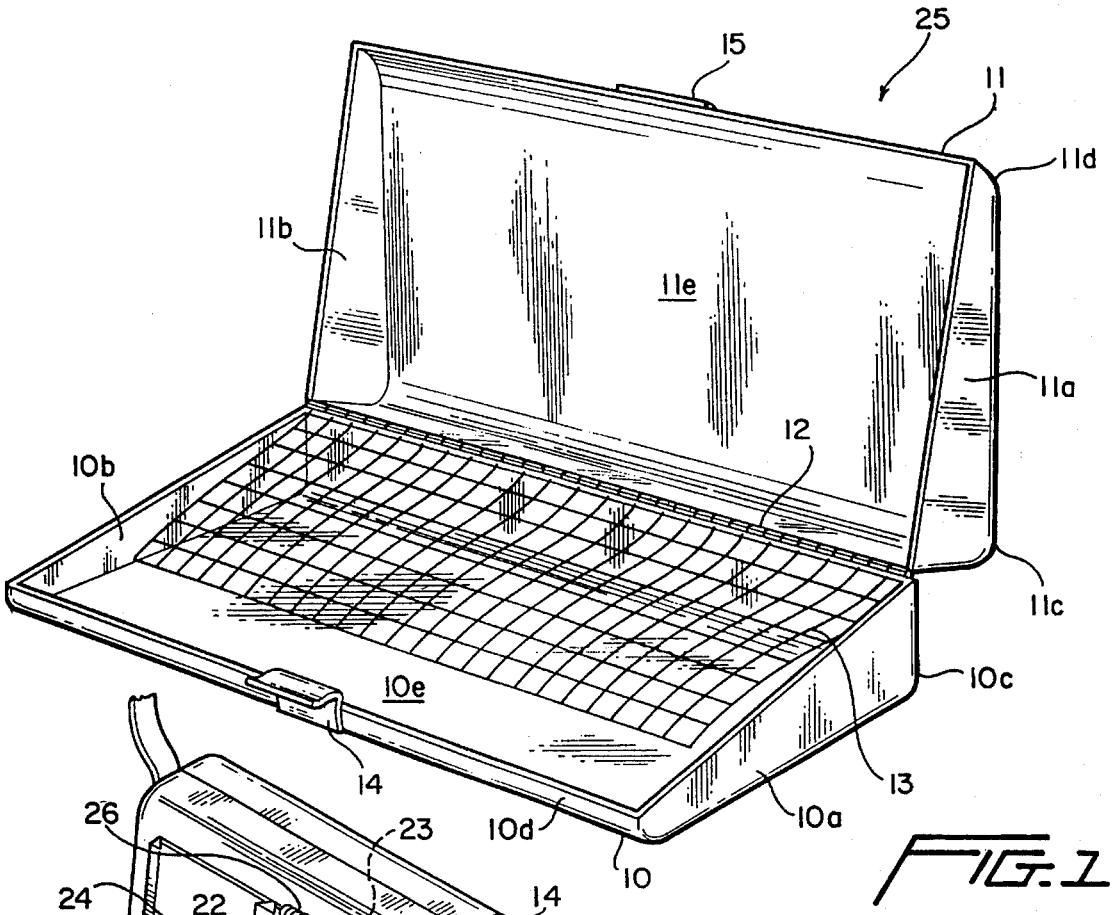
FIG. 1 is a perspective view of the combined scoring system and storage/carrier unit in its open position with the equipment removed therefrom.

Referring now to FIG. 1, there is shown the novel combined scoring system and equipment storage/carrier unit 25 in its "open" position prior to the storage of equipment therein. As illustrated, the unit 25 comprises a first housing portion 10 and a second housing portion 11 which are interconnected by a piano type hinge 12 permitting pivotal movement of said first and second housing portions 10 and 11. Attached to an inner portion of carrier 25 is stowing net 13. Stowing net 13 is approximately the same length and width as the internal planar dimensions of said first and second housing portions 10 and 11. Suitable securement means (not shown) are provided at the free end of stowing net 13 to hold the equipment in place when positioned thereunder.

Further, first and second housing portions 10 and 11, respectively, are each made of durable, impact and weather resistant plastic material. Each housing portion 10 and 11 is molded as a unitary piece and includes side walls 10*a*, 10*b* and 11*a*, 11*b*, respectively. Housing portions 10 and 11 also include base portions 10*c*, 11*c* and upper arcuate portions 10*d*, 11*d* with enlarged centrally located planar portions 10*e*, 11*e* interconnected with each of the aforementioned respective portions. Upper arcuate portions 10*d* and 11*d* include mating Velcro like strips 14 and 15, respectively. Velcro strips 14 and 15 provide an easy means for securing first and second housing portions 10 and 11 in the closed position in preparation for use as a scoring system or at the conclusion of a game after the equipment and supplies have been stowed therein. Other suitable closure means may be utilized for securing housing portions 10 and 11 in their closed position.

Figure 2:
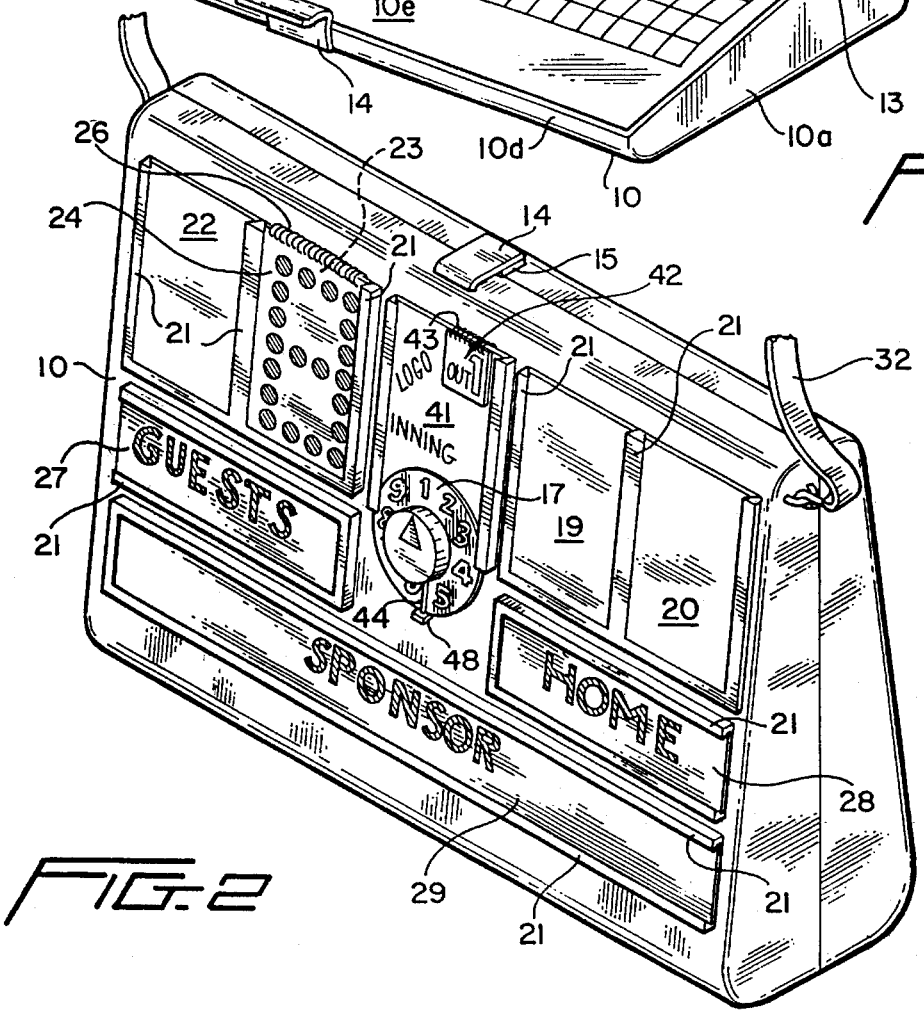
FIG. 2 is a perspective view of the combined scoring system and equipment storage/carrier unit illustrating the closed position as when utilized for scoring a game.

Turning now to FIG. 2, there is shown a front elevational perspective view illustrating the scoring system aspect of the invention. As illustrated, the combined scoring system and storage/carrier unit 25 is in its closed position with Velcro latching members 14 and 15 mated to hold the unit 25 closed. Scoring panel 22 is empty while panel 23, to its immediate right, is shown with scoring packet 24 inserted therein and showing the number eight. Scoring packet 24 consists of five number panels, each with a different number on its front and rear sides. All five panels provide a range of numbers from zero through nine and are held together as a packet by a spiral connector 26, or other suitable means. Scoring packet 24 is held in panel 23 by a plurality of continuous tracks 21 which are integrally formed with first housing portion 10. Although panels 19 and 20 are shown as formed by integral continuous tracks 21, other suitable means of securing the respective inserts therein may be utilized. For example, the outer surfaces of first and second planar housing portions 10*e* and 11*e* may be provided with self-adhesive plastic strips having an under-cut which would form the outer edges of the continuous tracks of the respective panels and receive the inserts therein. Centrally located between scoring panels 22,23 and 19,20 is another recessed panel 40 which receives inning/out insert 41. Inning/out insert 41 is also received in continuous tracks 21 until it engages stop 48 which locates insert 41. A slit 44 is provided in inning/out insert 41 to permit insert 41 to slide past mounting shaft 18A of pointer 18. In the upper right-hand corner of insert 41 is the out indicator 42 which includes a spiral connector 43 for numbers one through three. As the out changes, inning/out insert 41 is slid upward to clear the front housing portion 10 and the appropriate out is displayed and then inning/out insert 41 is slid down continuous track 21 until the bottom engages stop member 48.

As illustrated, number disk 17 shows numbers one through nine thereon. This is the side of insert 41 used to present the nine innings of play of any game so played. The pointer 18 is aligned with the appropriate inning number on number disk 17. Pointer 18 is rotated to the correct inning number as the game progresses. Additional inserts 41 are provided for other sporting activities which require different units of game time measurement. The remaining portions of the scoring system are discussed in detail with respect to FIG. 3, immediately hereafter.

Figure 3:
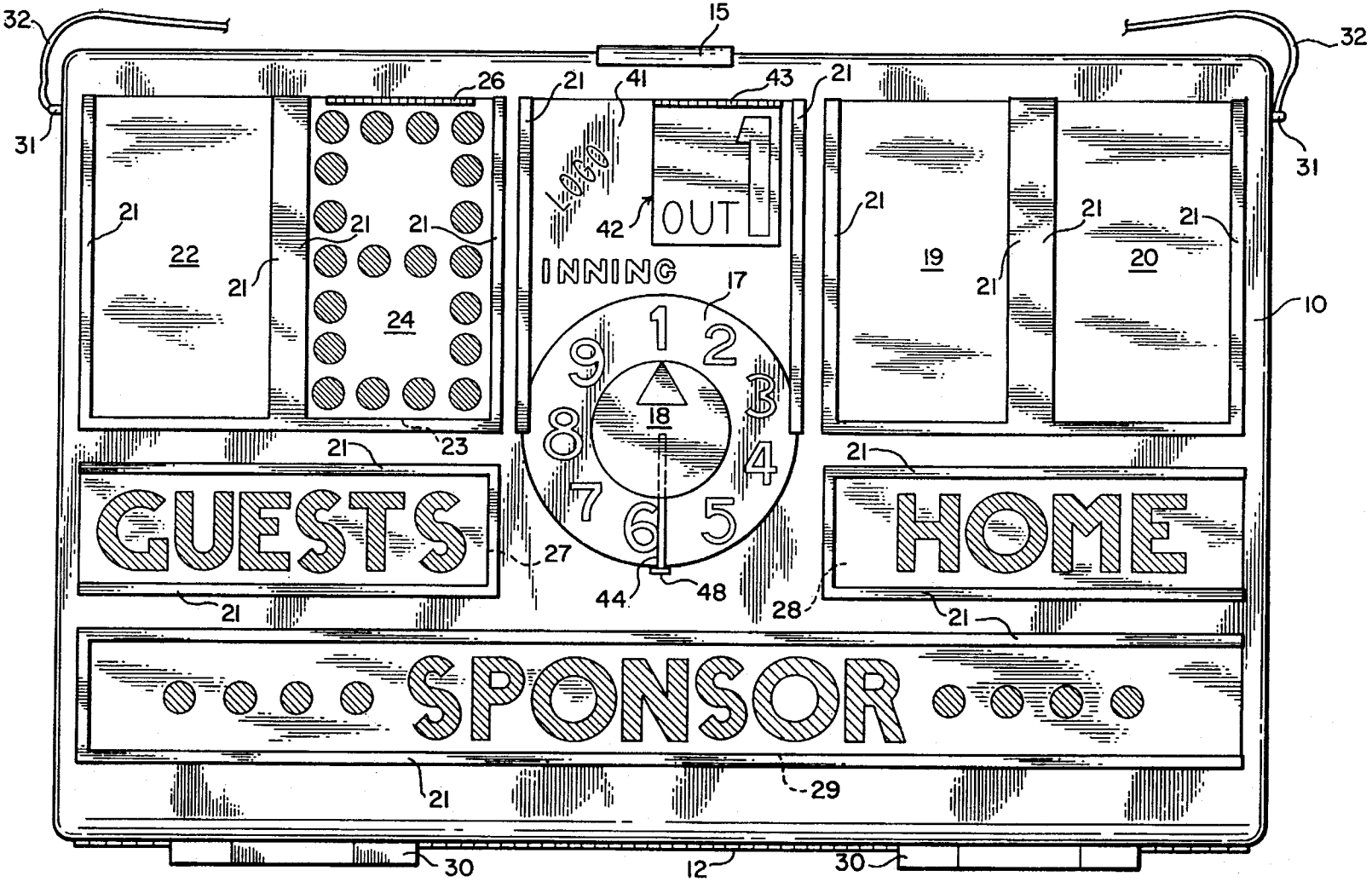
FIG. 3 is an enlarged front elevational view showing the details of the scoring system.

Referring now to FIG. 3, there is shown an enlarged front view of the scoring system which is located on the outer face of first housing portion 10. Centrally located on the outer face of first housing portion 10 is pointer 18 which cooperates with inning/out insert 41. As indicated earlier, to change the out, inning/out insert 41 must be raised vertically to clear first housing portion 10. Then out indicator 42 is flipped to the appropriate out and then re-inserted by sliding down continuous tracks 21 until the bottom of insert 41 engages stop member 48. Additional inserts 41 are provided for different games.

To the right of inning/out insert 41 are a pair of scoring panels 19 and 20 which are formed on the front face of first housing portion 10 by a plurality of integral continuous tracks 21 which overlap panels 19 and 20 and serve to hold the scoring numbers in place. As illustrated, the packet of scoring numbers has not been inserted therein. To the left of inning/out insert 41 is another pair of scoring panels 22, 23. Scoring panel 22 is empty, i.e. it does not have its packet of scoring numbers therein, while scoring panel 23 has its scoring packet 24. As illustrated, the upper portion of scoring packet 24 includes a spiral type connector 26 for holding the packet of number cards together. Each number card is provided with a different number on the front and back thereof. Thus, only five number cards are required in each scoring packet 24. The number cards are vinyl coated and the numbers are formed by a plurality of yellow dots on a black background to increase the visibility and recognition of the numbers displayed thereon. As the score of the game changes, the appropriate scoring packet 24 is slid upwardly out of its scoring panel and removed therefrom. Merely flipping the scoring packet to the appropriate number of the spiral connector 26 and then re-inserting it into the scoring panel from which it was removed is all that is required to make a score change.

Below each scoring panel 19, 20 and 22, 23 are a pair of horizontal short panels 27 and 28 for receiving a name insert of the "Guest" and "Home" teams, respectively. Each of these inserts slides in from the left and right sides, respectively. Again, a plurality of integrally molded continuous tracks 21 overlap each of the panels and serve to hold the name inserts in place. Immediately below panels 27 and 28 is an elongated single panel 29 which extends substantially the entire width of first housing portion 10. Here also, a plurality of integrally molded continuous tracks 21 overlap panel 29 which slidably receives an insert identifying the name of the team sponsor. Positioned below the lowermost edge of first and second housing portions 10 and 11 are a pair of supporting feet 30 which contribute to the stability of scoreboard storage/carrier unit 25 when used for scoring purposes. The upper end of unit 25 is provided with a pair of hooks 31 on opposite sides and serves as the attachment means for shoulder strap 32.

Figure 4:
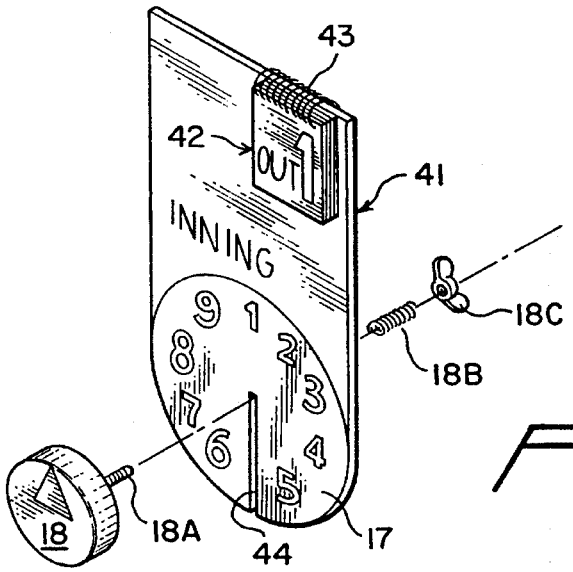
FIG. 4 is a detail view of the inning/out insert per se.

Referring now to FIG. 4, there is shown a detail view of inning/out insert 41 which is slidably received in recessed panel 40. Inning/out insert 41 is the insert used for playing baseball, softball or T-ball. As shown, insert 41 is provided with a stationary number disk 17 which includes numbers one through nine to indicate the inning of the game. A rotatable pointer 18 is mounted to the first housing portion 10 and includes a coil spring 18B which is mounted on the inside of first housing portion 10 to provide a bias to hold pointer 18 against first housing portion 10 when wing nut 18C is tightened on shaft 18A. As indicated, a slit 44 is provided to permit inning/out insert 41 to be slid into panel 40. The upper right-hand corner of insert 41 is provided with an out indicator 42 which includes three spiral mounted numbers, one through three, for indicating the out. Merely flipping the number panels changes the exposed out number.

Figure 5:
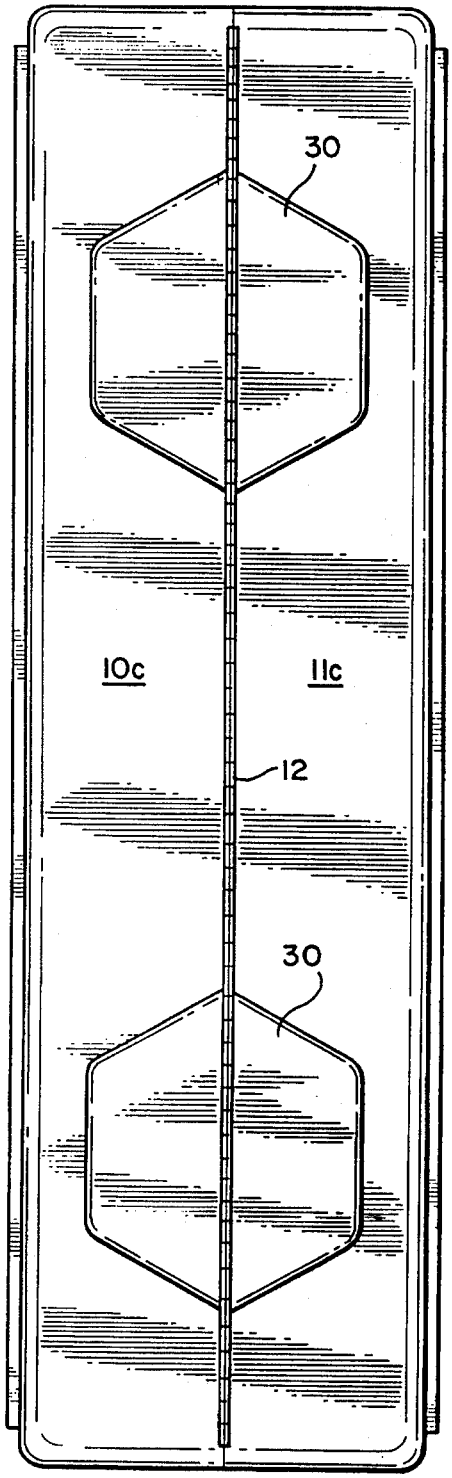
FIG. 5 is a bottom view of the combined scoring system and equipment storage/carrier unit showing the location of the stabilizing feet.

Referring now to FIG. 5, there is shown a bottom view of the combined scoring system and storage/carrier unit 25 illustrating the positioning of supporting feet 30.

Figure 6:
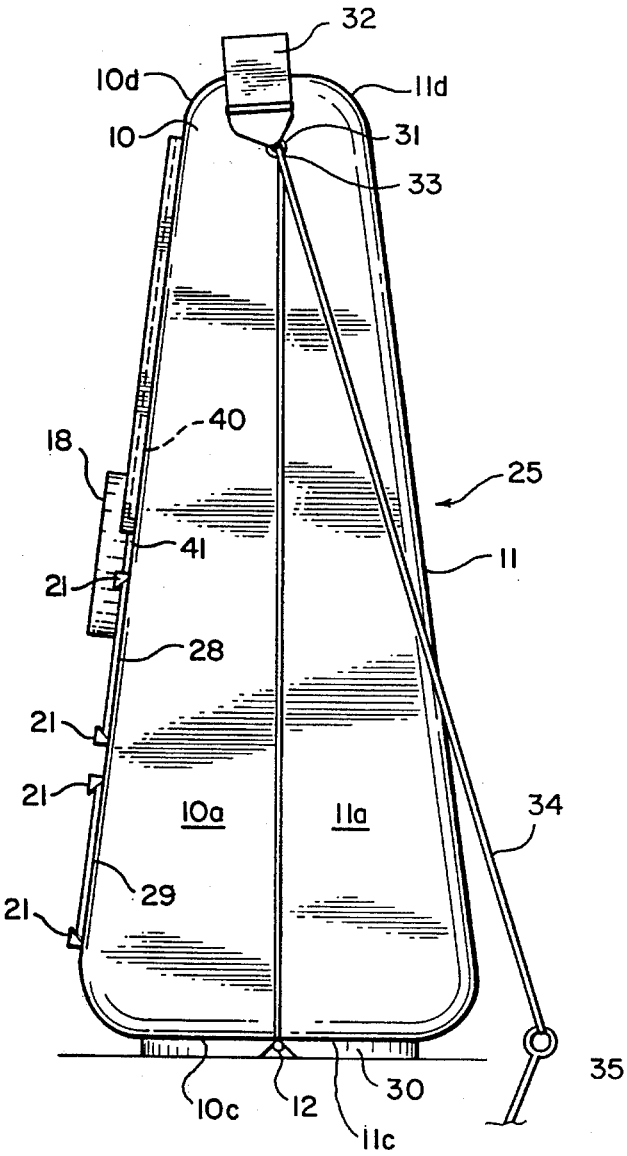
FIG. 6 is an end view of the combined scoring system and storage/carrier unit showing an optional shock-cord and stake for anchoring the unit.

Referring now to FIG. 6, there is shown an end view of the combined scoring system and storage/carrier unit 25. As shown, hook 31 which serves as the attachment means for shoulder strap 32 also serves as the attachment means for shock-cord 33 which connects anchor line 34 to ground stake 35 for stabilizing unit 25. Another anchor line 34 is located on the opposite side, however, it is not visible in this view.

Figure 7:
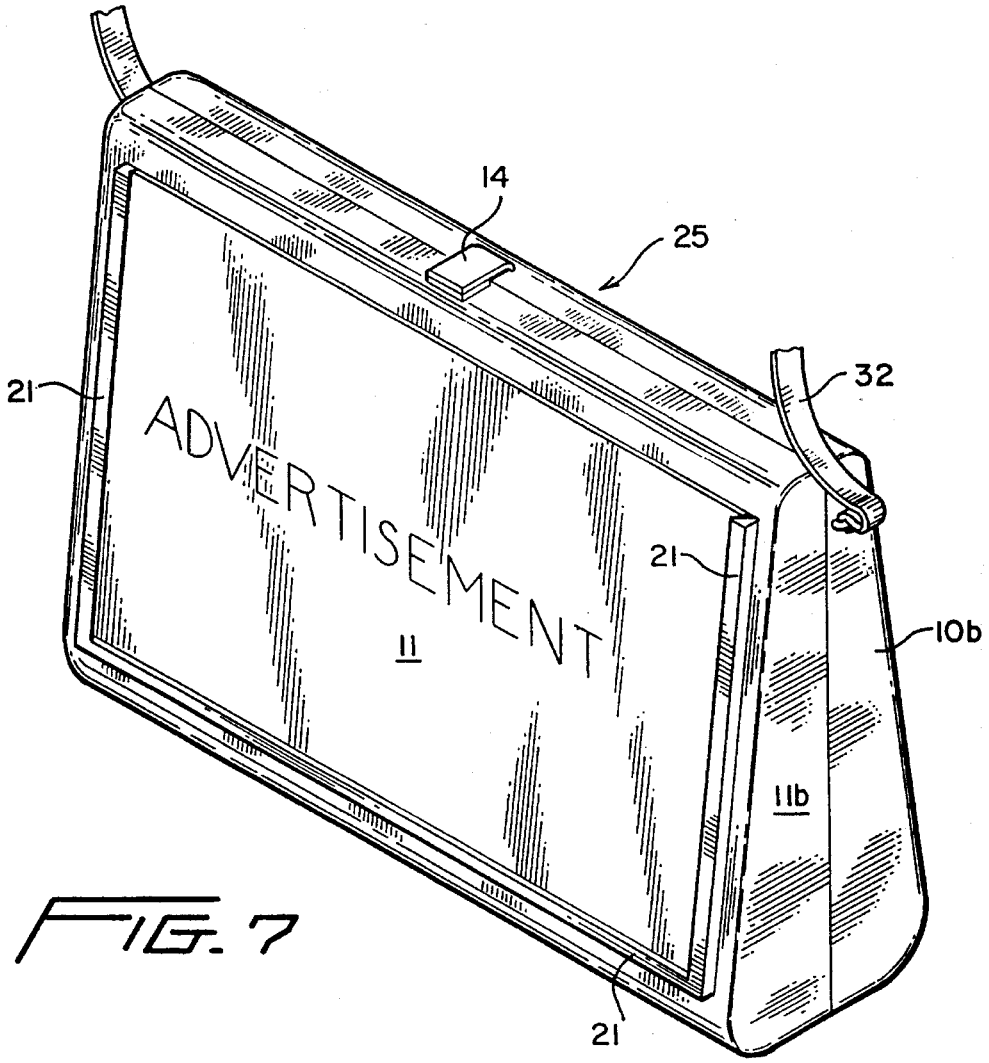
FIG. 7 is an elevational perspective of the rear side of the storage/carrier unit.

Referring now to FIG. 7, there is shown a continuous track 21 on three sides leaving an enlarged open area which can be utilized to receive additional advertising signs or other appropriate messages. As pointed out earlier, the use of a molded continuous track as the means of forming these pockets is but one example of how these pockets may be formed.

As can be seen from the above description, applicants have provided a portable, lightweight combined scoring and storage/carrier unit 25 which can be used for a variety of sporting activities. Whether or not the unit is used for scoring purposes, the unit 25 serves as a convenient storage/carrier unit for the game equipment, scoring numbers, first-aid supplies, team names and miscellaneous items such as snacks, jerseys, caps, and the like. Unit 25 is provided with a handy shoulder strap 32 for shoulder carrying.

While the invention has been described in its preferred embodiment, it is to be understood that the words which have been used are words of description rather than limitation and that changes may be made within the purview of the appended claims without departing from the full scope or spirit of the invention.

Having thus described our invention, we claim:

1. A combined portable game scoring system and equipment storage/carrier unit comprising:

first housing means including a base portion, a pair of oppositely disposed side wall portions and an upper end portion;

all of said aforementioned portions interconnected with an enlarged planar portion to form one half of said unit;

second housing means including a base portion, a pair of oppositely disposed side wall portions and an upper end portion;

all of said aforementioned portions of said second housing means interconnected with an enlarged planar portion to form a second half of said unit, said first and second housing means forming the outer walls of an enclosure within which items may be stored;

pivotal connection means for connecting said first and second housing means to form a storage area within said first and second housing portions;

latching means for holding said first and second housing portions in a closed position enclosing any equipment stored therein;

carrier means operably connected to said unit to allow carrying of said unit over the user's shoulder;

game scoring means for indicating the score of the game in progress and period of play indicator means for indicating the current status of the game located on an outer surface of one of said first and second housing means whereby said unit is first utilized as a storage/carrier unit and upon arrival at a playing site, said storage area is emptied, said first and second housing means are closed and positioned in an upright position whereupon said outer face of one of said housing means is now utilized to score a game and indicate the period of play of said game.

2. A combined scoring system and equipment storage/carrier unit as defined in claim 1 wherein said first housing means includes a stowage net for securing items within said unit.

3. A combined scoring system and equipment storage/carrier unit as defined in claim 1 wherein said pivotal connection means comprises a hinge interconnecting said first and second housing means and secured thereto to allow access therein.

4. A combined scoring system and equipment storage/carrier unit as defined in claim 1 wherein said latching means comprises a first hook member secured to said first housing means and a second loop member secured to said second housing means whereby said hook and loop members cooperate to hold said first and second housing means together when said hook and loop members are brought into mating engagement.

5. A combined scoring system and equipment storage/carrier unit as defined in claim 1 wherein said carrier means comprises a pair of eye hooks which are secured to the upper ends of said oppositely disposed walls portions and a shoulder strap secured at each end to one of said pair of eye hooks whereby said storage/carrier unit can be carried over one's shoulder leaving the user's hands free.

6. A combined scoring system and equipment storage/carrier unit as defined in claim 1 wherein said game scoring means includes a plurality of pocket means positioned on the outer surface of said first housing means and interchangeable numbers received in said pockets means whereby said interchangeable numbers can be removed from said pockets, changed to the correct numbers and re-inserted into said pockets.

7. A combined scoring system and equipment storage/carrier unit as defined in claim 6 wherein said plurality of pockets means are formed by a plurality of continuous tracks having overlapping portions which serve to guide and retain said interchangeable numbers therein.

8. A combined scoring system and equipment storage/carrier unit as defined in claim 1 wherein said period of play indicator means comprises a rotatable pointer rotatably mounted to the outer surface of said first housing portion means, an inning/out insert including a stationary disk having a different number arrangement on each side thereof whereby said inning/out can be reversed and said rotatable pointer rotated to indicate quarters or innings of play depending on the game in progress.

9. A combined game scoring system and equipment storage/carrier unit comprising:

a first housing means having a base portion, a pair of oppositely disposed side wall portions and an upper end portion;

all of said aforementioned portions interconnected by an enlarged planar portion;

said first housing means including a plurality of pocket means on an outer surface thereof for receiving intechangeable numbers therein and period of play indicator means located between said interchangeable numbers;

a second housing means having a base portion, a pair of oppositely disposed side wall portions and an upper end portion, said first and second housing means forming the outer walls of an enclosure within which items may be stored;

all of said aforementioned portions of said second housing means interconnected by an enlarged planar portion;

both of said planar portions provided with pocket means on the outer surfaces thereof;

pivotal connection means interconnecting said first and second housing means to form an enclosure therein;

said first and second housing means cooperating to form an enclosure therebetween;

stowing means attached to one of said first and second housing means for securing game related items in said enclosure;

latching means for holding said first and second housing means in a closed position and carrier means attached to one of said housing means for shoulder carrying whereby sporting equipment can be stored within said enclosure, said latching means latched closed and said unit can be carried by said carrier means.

10. A combined game scoring system and equipment storage/carrier unit as defined in claim 9 wherein said first and second housing means are made of molded, high strength, impact and weather resistant plastic material.

11. A combined game scoring system and equipment storage/carrier unit as defined in claim 9 wherein said plurality of pockets including scoring number pockets, an inning/out pocket, team name pockets and sponsor name pockets;

each of said pockets including a plurality of continuous tracks about the periphery of said pockets for holding said scoring numbers, team names, inning/out insert and sponsor names in place within said pockets.

12. A combined game scoring system and equipment storage/carrier unit as defined in claim 9 wherein said period of play indicator means comprises an inning/out insert which is removably mounted in said inning/out pocket and a rotatable pointer mounted on first housing portion; said inning/out insert including a stationary disk having numbers thereon which cooperates with said rotatable pointer for indicating the period of play when aligned with said pointer said inning/out insert further including an out display for indicating the current out of the particular inning.

13. A combined game scoring system and equipment storage/carrier unit as defined in claim 12 wherein said inning/out insert is reversible and is provided with a different numbering arrangement on its reverse side thus allowing use with games having different periods of play.

14. A combined game scoring and equipment storage/carrier unit as defined in claim 9 wherein said latching means comprises a pair of hook and loop members atached to an upper portion of each of said first and second housing means whereby upon mating engagement of said hook and loop members, said unit is securely held in a closed position.

15. A combined game scoring system and equipment storage/carrier unit as defined in claim 9 wherein said carrier means includes a pair of oppositely disposed eyebolts attached to said first housing means and a nylon shoulder strap interconnected with said eyebolts for carrying said unit over one's shoulder.

16. A combined game scoring system and equipment storage/carrier unit comprising:

first and second housing means pivotally connected to form an enclosure therein;

one of said first and second housing means including a plurality of pockets in an outer surface thereof;

number packet means for indicating a game score when inserted in said pockets;

a plurality of continuous tracks surrounding said pockets for holding said number packets therein;

anchoring means attached to said housing means and anchored to surrounding ground to stabilize said unit when used for game scoring purposes.

17. A combined game scoring system and equipment storage/carrier unit as defined in claim 16 wherein said number packet means comprises a plurality of number cards, each number card having a different number on each side thereof;

said number cards secured together as a packet by means of a connector whereby said packet of number cards can be removed and changed to the correct score number and re-inserted into said pockets.

* * * * *